US006367166B1

(12) United States Patent
Barthelemy et al.

(10) Patent No.: US 6,367,166 B1
(45) **Date of Patent: *Apr. 9, 2002**

(54) BOOT HAVING STRUCTURE FOR DRAINING AND EVACUATING MOISTURE

(75) Inventors: Antoine Barthelemy, Annecy le Vieux; Jacques Tholin, Annecy, both of (FR)

(73) Assignee: Salomon S.A., Metz-Tessy (FR)

( * ) Notice: Subject to any disclaimer, the term of this patent is extended or adjusted under 35 U.S.C. 154(b) by 0 days.

This patent is subject to a terminal disclaimer.

(21) Appl. No.: 09/881,714

(22) Filed: Jun. 18, 2001

Related U.S. Application Data

(63) Continuation of application No. 09/334,619, filed on Jun. 17, 1999, now Pat. No. 6,260,288.

(30) Foreign Application Priority Data

Jun. 29, 1998 (FR) ..... 98 08492

(51) Int. Cl.[7] ..... A43B 7/06; A43B 23/07
(52) U.S. Cl. ..... 36/3 R; 36/55; 36/45
(58) Field of Search ..... 36/10, 55, 3 R, 36/3 A, 45

(56) References Cited

U.S. PATENT DOCUMENTS

| | | | | |
|---|---|---|---|---|
| 2,688,810 | A | 9/1954 | Baumann | |
| 2,869,253 | A | 1/1959 | Sachs | |
| 3,694,940 | A | 10/1972 | Stohr | |
| 4,599,810 | A | 7/1986 | Sacre | |
| 5,014,363 | A | 5/1991 | Hubner et al. | |
| 5,339,545 | A | 8/1994 | Paris | |
| 5,511,323 | A | 4/1996 | Dahlgren | |
| 5,746,013 | A | 5/1998 | Fay | |
| 6,260,288 | B1 * | 7/2001 | Barthelemy et al. | 36/3 R |

FOREIGN PATENT DOCUMENTS

| | | |
|---|---|---|
| DE | 584727 | 2/1932 |
| EP | 0857433 | 9/1998 |
| FR | 717108 | 5/1931 |
| FR | 2071900 | 9/1971 |
| JP | 404105601 | 4/1992 |
| NO | 70430 | 5/1946 |

* cited by examiner

*Primary Examiner*—M. D. Patterson
(74) *Attorney, Agent, or Firm*—Greenblum & Bernstein P.L.C.

(57) ABSTRACT

A footwear that includes a foot covering and a lining, wherein the lining includes a multilayered fabric having two parallel textile surfaces connected together via a layer of threads, extending substantially perpendicularly to the plane constituted by each of the two surfaces, and defining a compressible space between the two parallel surfaces. The compressible space extends from a base to an upper end of the foot covering and the lining is connected to the foot covering upper via a turned-over top peripheral stitch.

21 Claims, 2 Drawing Sheets

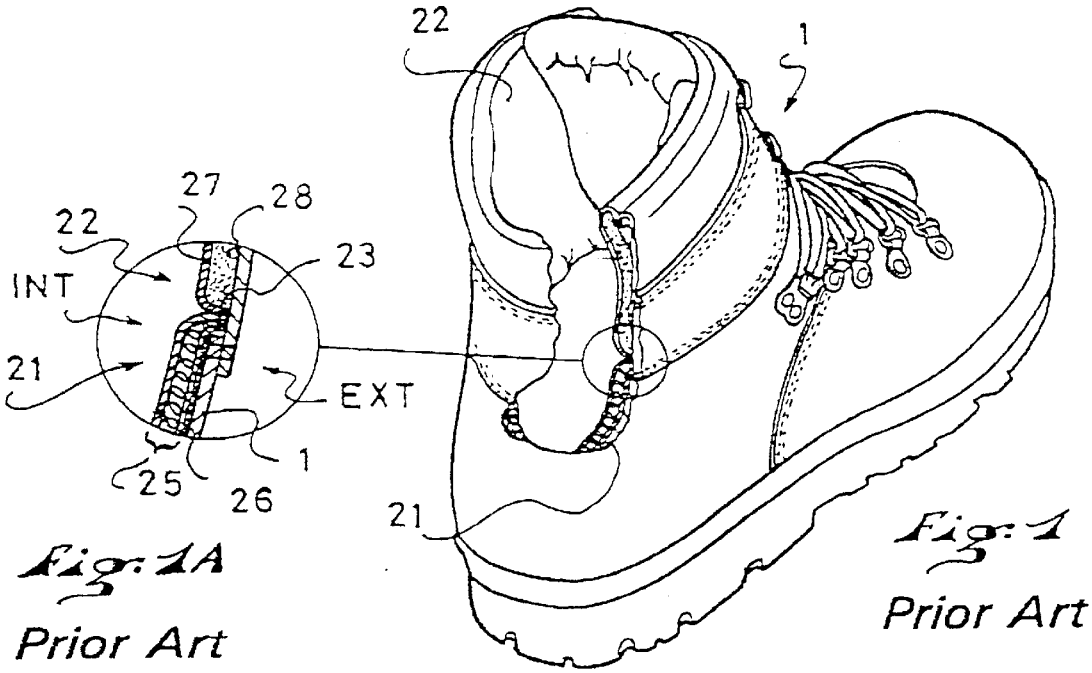
Fig. 1A
Prior Art
Fig. 1
Prior Art
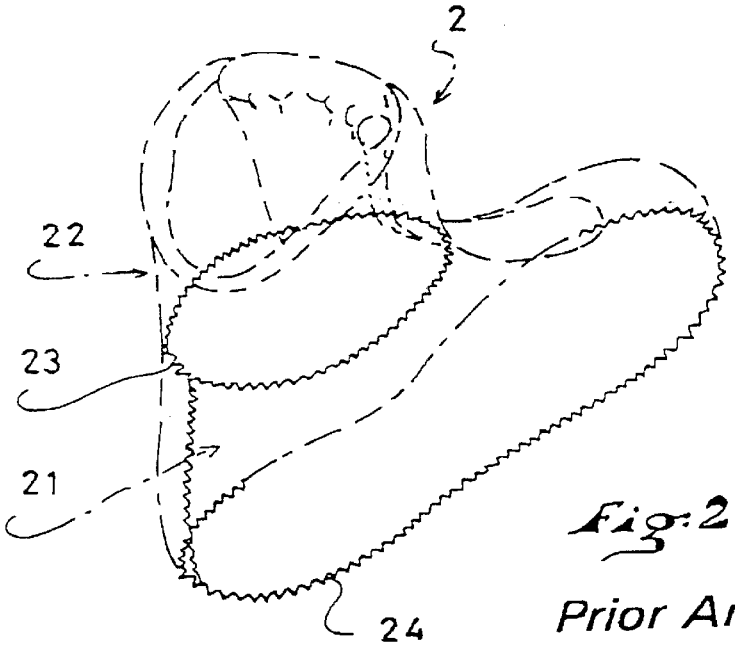
Fig. 2
Prior Art

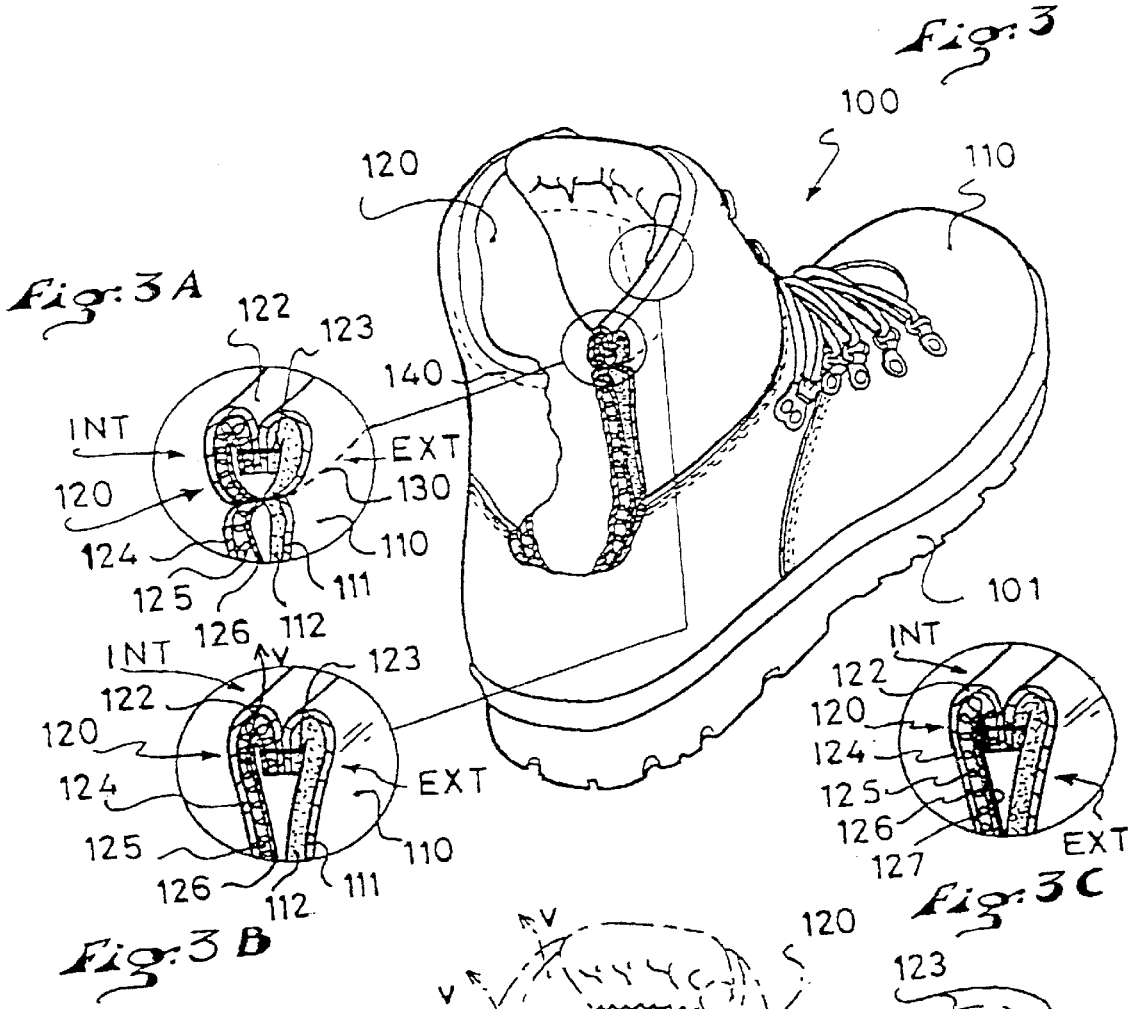
Fig: 3
100
110
120
101
Fig: 3A
122
123
140
INT
EXT
130
120
124
110
125
111
126
112
INT
122
123
120
124
EXT
125
110
126
112
111
Fig: 3B
INT
122
120
124
125
126
127
EXT
Fig: 3C
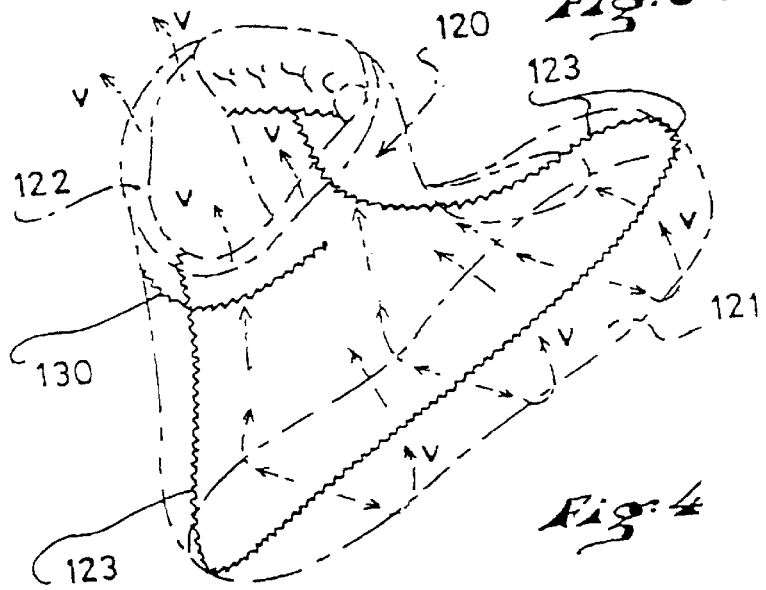
V
120
123
122
121
130
123
Fig: 4

BOOT HAVING STRUCTURE FOR DRAINING AND EVACUATING MOISTURE

CROSS-REFERENCE TO RELATED APPLICATIONS

The present application is a continuation of U.S. application Ser. No. 09/334,619, filed Jun. 17, 1999, now U.S. Pat. No. 6,260,288, the disclosure of which is expressly incorporated by reference herein in its entirety. The present application also claims priority under 35 U.S.C. § 119 of French Patent Application No. 98 08492 filed on Jun. 29, 1998, the disclosure of which is hereby expressly incorporated by reference thereto in its entirety.

BACKGROUND OF THE INVENTION

1. Field of the Invention

The instant invention is related to a boot, specifically a sports boot, such as a hiking boot, which accommodates moisture drainage and evacuation.

2. Description of Background and Relevant Information

The problem of circulation and evacuation of air from inside a boot is a long-standing one, and it has never been resolved in a totally satisfactory manner.

As such, the alpinist ski boot, known by its trade name "CLIMA-COMPREX" by Kolfach, consists of an impermeable outer envelope and an inner liner, equipped on its outer wall with longitudinal channels that communicate with through holes of the liner and are adapted to evacuate the moisture laden air.

The problem with such a boot is that the air evacuation output is very limited and, consequently, there is inadequate airing for the elimination of moisture. Furthermore, the spacing of the foot from the outer wall of the liner causes condensation problems, and this becomes accentuated because the outer envelope is exposed to the cold.

Various constructions have also been attempted with the so-called "breathable waterproof" materials, i.e., materials that are permeable to water vapor but impermeable to water. These constructions certainly provide an excellent impermeability against the elements, but they have the disadvantage of being inadequate in terms of breathability or evacuation of moisture.

As a matter of fact, the so-called "breathable waterproof" materials or membranes provide very little breathability, and indeed only fulfill 10% of the moisture evacuation needs of the foot.

More recently, as illustrated in FIGS. 1 and 2, the company Boréal has developed a mountaineering boot constituted of an external upper 1 made of leather, and a lining 2 shaped like a liner, adapted to evacuate moisture, and constituted of a lower portion 21 surrounding the actual foot portion and an upper portion 22 surrounding the ankle portion.

As shown in greater detail in FIG. 1A, the lower portion 21 of the lining 2 is made of a multi-layered material, consisting of, from the inside outwards:

- a three dimensional fabric 25, a "breathable waterproof" membrane, of the type known by the trade name "Sympatex", adhered to the protective textile layer 26 (abrasion resistance),
- a leather layer constituting the external upper 1.

The upper portion 22 of the lining is constituted of a leather layer 27 and foam layer 28.

The two parts 21–22 are connected via a top peripheral stitch 23, while a bottom peripheral stitch 24 provides the assembly of the lower portion 21 of the liner.

The use of the three-dimensional fabric 25 is adapted to allow the evacuation of water vapor towards the outside in a vertical and transverse direction.

In practice, however, this evacuation is blocked in the vertical direction by the presence of the top peripheral stitch 23 and the bottom peripheral stitch 24.

As a result, the perspiration can only be evacuated transversely in the lower portion 21 of the lining, through the "breathable waterproof" membrane 26 and the external leather wall of the external upper 1.

However, as indicated previously, these "breathable waterproof" materials do not provide an adequate evacuation of moisture, and the resulting effect is therefore not satisfactory.

SUMMARY OF THE INVENTION

It is therefore an object of the instant invention to overcome these drawbacks and to provide an improved boot construction, enabling a better evacuation of the moisture produced by perspiration.

This object is achieved in the boot according to the invention, which is of the type constituted of an external upper and an internal lining, due to the fact that the internal lining is constituted of a multilayered fabric that includes two parallel textile surfaces connected together by a layer of threads extending mainly perpendicularly to the plane constituted by each of the two textile surfaces, and defining a compressible space between these two textile surfaces, due to the fact that it extends from the bottom to the upper end of the external upper, and that it is only connected to the external upper via a top peripheral stitch.

The multilayered fabric, more commonly known by the term three-dimensional fabric, defines a layer of air surrounding the foot along the entire surface of the boot and rises to the top of the boot upper, thus enabling an optimum evacuation of moist air from the foot all the way to the top of the boot, and this is achieved by a maximum exchange surface.

Such a construction resolves the problem of having an exchange surface that is too limited, as was the case in the constructions using a "breathable waterproof" layer, or a system of channels and through holes, as described previously.

In addition, the assembly of the lining to the external upper via a single top peripheral stitch guarantees that the moist air can be evacuated in an essentially vertical direction, i.e., from the bottom towards the top of the boot.

According to a preferred embodiment, the inner lining forms a liner assembled via a single median longitudinal stitch. This construction also guarantees a good circulation of moist air because it can be evacuated from the median stitch of the sole towards the sides of the liner.

The invention also provides for a boot comprising an external upper comprising an external sole and an upper end having an edge, an internal lining including an upper edge and a base disposed adjacent the external sole of the external upper, the internal lining comprising a multilayered fabric which includes two parallel textile surfaces connected together via a layer of threads extending substantially perpendicularly with respect to the two parallel textile surfaces, a compressible space being defined between the two parallel surfaces and extending from the base of the internal lining to the upper end of the external upper, the upper edge of the internal lining being connected to the edge of the external upper via a turned over top peripheral stitch, wherein the internal lining allows perspiration to circulate from the base to the top peripheral stitch.

The internal lining may allow perspiration originating within the internal lining to circulate freely from the base to the top peripheral stitch. The lining may comprise a sole portion adapted to receive a foot. The internal lining may comprise a plurality of multilayered fabric pieces which are assembled together via a single, substantially median, longitudinal stitch. At least one of the two parallel textile surfaces may comprise a breathable waterproof membrane. The external upper may comprise at least a partially breathable material. The at least partially breathable material may be leather. The multilayered fabric may be a three-dimensional fabric generally comprising two independent textile webs separated by the space and wherein the space comprises an aerated layer. At least one of the two parallel textile surfaces may comprise a jersey web. At least one of the two parallel textile surfaces may comprise one of a woven and a non-woven thread web. The internal lining may comprise a three-dimensional fabric which is made of synthetic water-resistant materials. One of the two parallel surfaces may comprise an inner surface adapted to contact a foot, the inner surface comprising a large mesh jersey material adapted to allow optimal evacuation in a direction substantially perpendicular to the two parallel textile surfaces. Another of the two parallel surfaces may comprise an outer surface disposed adjacent the external upper, and wherein the boot further comprises an additional layer disposed between the outer surface and the external upper. The additional layer may comprise a breathable waterproof membrane. The breathable waterproof membrane may comprise one of Gore Tex® and Sympatex® and Clima Dry®. The additional layer may comprise a tight mesh fabric. The internal lining may comprise two pieces of multilayered fabric which are assembled together via a single longitudinal stitch which is arranged substantially along a median longitudinal plane of the internal lining. The internal lining may allow perspiration originating within the internal lining to circulate freely from the base of the internal lining to the longitudinal stitch, the internal lining allowing perspiration to rise vertically within the space.

The longitudinal stitch may comprise the only horizontal stitch in the internal lining between the base and the upper edge of the internal lining. An entire internal surface of the internal lining may be adapted to evacuate perspiration generated moisture, via convection, from the base upwards to the longitudinal stitch, the perspiration being a vertical circulation of hot moist air which moves through the space. The internal lining may be connected to the external upper via a horizontal stitch, the horizontal stitch being disposed between the base and the top peripheral stitch, and wherein the horizontal stitch extends along a portion of a perimeter of the external upper.

The invention also provides for a boot comprising an external upper comprising an external sole and an upper end having an edge, an internal lining including an upper edge and a base disposed adjacent the external sole of the external upper, the internal lining comprising a multilayered fabric which includes two parallel textile surfaces made of a synthetic water-resistant material and connected together via a layer of synthetic water-resistant material threads extending substantially perpendicularly with respect to the two parallel textile surfaces, a compressible space being defined between the two parallel surfaces and extending from the base of the internal lining to the upper end of the external upper, the upper edge of the internal lining being connected to the edge of the external upper via a turned over top peripheral stitch, wherein the internal lining allows perspiration originating within the internal lining to circulate within the compressible space from the base to the top peripheral stitch.

The invention further provides a footwear comprising at least one sole, a foot covering having an upper end and arranged above the at least one sole, a lining arranged within the foot covering and having a lower end and an upper end, the lining comprising a multilayered fabric which includes two parallel textile surfaces connected together via a layer of threads extending substantially perpendicularly with respect to the two parallel textile surfaces, a compressible space being defined between the two parallel surfaces and extending from the lower end the lining to the upper end of the lining, and the upper end of the lining being connected to the upper end of the foot covering via a turned over top peripheral stitch, wherein the lining allows perspiration to circulate from the lower end of the lining to one of the upper end of the lining and the top peripheral stitch.

The invention additionally provides for a footwear comprising a foot covering having an upper end arranged above a sole, a lining arranged within the foot covering and having a sole, a lower end and an upper end, the lining comprising a multilayered fabric which includes two parallel textile surfaces connected together via a layer of threads extending substantially perpendicularly with respect to the two parallel textile surfaces, a compressible space being defined between the two parallel surfaces and extending from the sole of the lining to the upper end of the lining, and the upper end of the lining being connected to the upper end of the foot covering via a turned over top peripheral stitch, wherein the lining allows perspiration to circulate from one of the sole and the lower end of the lining to one of the upper end of the lining and the top peripheral stitch.

The invention contemplates a footwear comprising a sole on at least one of a foot covering and a lining, the foot covering having an upper end and arranged above the at least one sole, the lining arranged within the foot covering and having a lower end and an upper end, the lining comprising a multilayered fabric which includes two parallel textile surfaces connected together via a layer of threads extending substantially perpendicularly with respect to the two parallel textile surfaces, a compressible space being defined between the two parallel surfaces and extending from the lower end the lining to the upper end of the lining, and the upper end of the lining being connected to the upper end of the foot covering via a turned over top peripheral stitch, wherein the lining allows perspiration to circulate from the lower end of the lining to one of the upper end of the lining and the top peripheral stitch.

The lining may comprise a material which allows perspiration originating within the lining to circulate freely from the lower end to the top peripheral stitch. Each of the lining and the foot covering may comprise a sole. The lining may comprise a plurality of multilayered fabric pieces which are assembled together via a single, substantially median, longitudinal stitch. At least one of the two parallel textile surfaces may comprise a breathable waterproof membrane. The foot covering may comprise at least a partially breathable material. The at least partially breathable material may be leather. The multilayered fabric may be a three-dimensional fabric generally comprising two independent textile webs separated by the space and wherein the space comprises an aerated layer. At least one of the two parallel textile surfaces may comprise a jersey web. At least one of the two parallel textile surfaces may comprise one of a woven and a non-woven thread web.

The lining may comprise a three-dimensional fabric which is made of synthetic water-resistant materials. One of the two parallel surfaces may comprise an inner surface adapted to contact a foot, the inner surface comprising a large mesh jersey material adapted to allow optimal evacuation in a direction substantially perpendicular to the two parallel textile surfaces. Another of the two parallel surfaces may comprise an outer surface disposed adjacent the foot covering, and wherein the footwear further comprises an additional layer disposed between the outer surface and the foot covering. The additional layer may comprise a breathable waterproof membrane. The additional layer may comprise a tight mesh fabric. The lining may comprise two pieces of multilayered fabric which are assembled together via a single longitudinal stitch which is arranged substantially along a median longitudinal plane of the lining.

The lining may allow perspiration originating within the lining to circulate freely from the lower end of the lining to the longitudinal stitch, the lining allowing perspiration to rise vertically within the space. The longitudinal stitch may comprise the only horizontal stitch in the lining between the lower end and a upper edge of the lining. An entire internal surface of the lining may be adapted to evacuate perspiration generated moisture, via convection, from the lower end upwards to the longitudinal stitch, the perspiration being a vertical circulation of hot moist air which moves through the space. The lining may be connected to the foot covering via a horizontal stitch, the horizontal stitch being disposed between the lower end and the top peripheral stitch, and wherein the horizontal stitch extends along a portion of a perimeter of the foot covering.

The invention contemplates a footwear comprising a foot covering having an upper end arranged above a sole, a lining arranged within the foot covering and having a sole, a lower end and an upper end, the lining comprising a multilayered fabric which includes two parallel textile surfaces connected together via a layer of threads extending substantially perpendicularly with respect to the two parallel textile surfaces, a compressible space being defined between the two parallel surfaces and extending from the sole of the lining to the upper end of the lining, and the upper end of the lining being connected to the upper end of the foot covering via a turned over top peripheral stitch, wherein the lining allows perspiration to circulate from one of the sole and the lower end of the lining to one of the upper end of the lining and the top peripheral stitch.

BRIEF DESCRIPTION OF THE DRAWINGS

The invention will be better understood and other characteristics thereof will become apparent with the aid of the following description provided in reference to the annexed schematic drawings, wherein:

FIG. 1 is a rear perspective view with a partial cut-out, of a prior art boot;

FIG. 1A is a detailed view of FIG. 1;

FIG. 2 is a rear perspective view of a prior art liner;

FIG. 3 is a view similar to FIG. 1 of a boot according to the invention;

FIG. 3A is a detailed view of FIG. 3;

FIG. 3B is a detailed view of FIG. 3;

FIG. 3C is a detailed view similar to FIG. 3B according to another embodiment; and FIG. 4 is a view similar to FIG. 2 of a liner according to the invention.

DETAILED DESCRIPTION OF THE INVENTION

As specifically shown in FIGS. 3 and 4, the boot 100 according to the invention includes an external upper 110, a sole 101, and an inner lining 120 shaped like a liner.

Contrary to the liner 2 of the known prior art, the liner 120 according to the invention has a continuous structure from the base, i.e., its sole 121, to its upper end 122.

As illustrated in FIG. 3A, the liner 120 comprises a three-dimensional multilayered fabric, namely two parallel textile surfaces or webs, inner 124 and outer 126, respectively, both these surfaces 124 and 126 being connected together via a layer of threads 125 extending mainly perpendicularly to the plane constituted by each of such surfaces, and defining an elastically compressible air space between these two surfaces 124 and 126. Such a three-dimensional fabric is generally constituted during the same manufacturing step. It can also be constituted with the help of two textile webs obtained independently of one another and connected thereafter via an aerated layer depending on its thickness. The two surfaces 124 and 126 are preferably constituted ofjersey webs; they can also be constituted of woven or non-woven thread webs.

In all cases, the materials constituting the three-dimensional fabric are preferably synthetic, hydrophobic materials.

Preferably, the inner surface 124, which is the closest to the user's foot, is made of a large mesh jersey adapted to allow optimal evacuation in the radial direction (i.e., substantially perpendicularly to the plane of the layer 124), of the perspiration generated by the foot.

Preferably, though not necessarily, the outer surface 126 is associated to an additional layer 127 equipped with an "breathable waterproof" membrane (see FIG. 3C) such as those known by the trade names "Gore Tex","Sympatex" or "Clima Dry".

In this case, the additional layer 127 is preferably constituted of a tight mesh fabric so as to form an efficient support for the membrane and protect it against abrasion.

As shown in FIG. 4, the liner 120 is made from two cut pieces of multilayered fabric, assembled along a single longitudinal stitch 123 arranged substantially along a median longitudinal plane of the liner 120.

As a result, the perspiration produced by the foot can circulate freely from the sole 121 of the lining, on either side of the longitudinal stitch 123, and rise along the vertical walls of the lining, without getting stopped by horizontal stitches (like the stitches 23 of the liner of FIG. 2), until it reaches the upper end 122 of the lining as illustrated by the arrows V.

As a result, the entire surface of the lining 120 can be used to evacuate the perspiration generated moisture, via convection, from the base upwards, by the vertical circulation of hot moist air through the air layer defined by the layer 125.

Since the moisture is mainly evacuated in a longitudinal direction, i.e., in the plane or thickness of the material constituting the lining, as opposed to an evacuation in the radial direction through the wall of the material as was the case in the known boot of FIGS. 1 and 2, the addition of a layer 127 having an "breathable waterproof" membrane does not hamper the evacuation of moisture and, in addition, it allows obtaining the desired impermeability in a construction that is truly a "breathable waterproof material".

As shown in FIG. 3A, the lining 120 is connected at its upper end 122—edge to edge—to the external upper 110 by a peripheral stitch 123 which is then turned over, such stitch 123 therefore not hindering the circulation of moist air up towards the upper end 122 of the lining.

A "through" stitch 130 can also be provided between the lining 120 and the external upper 110 so as to define a comfort padding at the rear of the boot. As long as this stitch 130 only extends along a portion of the perimeter of the upper end 122 of the lining, it does not overly impede the upward evacuation of the perspiration.

The upper 110 is preferably constituted of a breathable material such as leather 111, associated to a comfort material, such as the foam 112. All types of materials, including impermeable materials, can be used for all or a portion of the upper.

It should be noted that the three-dimensional structure of the lining also allows limiting the quantity and thickness of the comfort foams 112 for the upper since the air layer defined by the three dimensional structure itself provides a certain degree of comfort.

The air circulation V described hereinabove occurs notably due to a pumping effect (contraction/relaxation of the materials) linked to the deformations of the boot while walking.

The effect of circulating and evacuating moist air via the lining construction described hereinabove has been surprisingly found to be extremely advantageous, at least for the following reasons:

the moist air remains in the gaseous state in the lining because it remains very close to the foot, which is itself hot, and therefore does not get condensed, as was the case in the liner structures with circulating channels provided at the end of the liner, the three dimensional fabric captures the moisture due to the capillary nature of its inner surface that is in contact with the sock or the user's foot and evacuates it, such that the moisture remaining in contact with the foot is almost nil.

In addition, this structure offers other advantages:

as indicated previously, the three-dimensional fabric adds to the comfort via its inner elastic layer which can get deformed in a localized and elastic manner in case of compression. Furthermore, this elastic layer always returns to its initial position and therefore does not get crushed like normal foams, the air layer stored in the three dimensional fabric reinforces the thermal insulation of the boot and therefore allows the elimination of foam thicknesses provided for this purpose. Therefore, while providing the same level of thermal comfort, the boot has fewer foams capable of storing moisture and increasing its weight, the three-dimensional fabric lining dries much more quickly than traditional linings due to the fact that it is constituted from water resistant materials, and also because it has a substantial exchange surface.

The instant invention is not to be limited to the embodiment described hereinabove as a non-restrictive example but encompasses all similar or equivalent embodiments thereof.

Specifically, its application is not limited to an application of a lining of the liner type, i.e., including a structure with a sole, and can function very efficiently with lining portions that extend from the base to the upper end of the upper.

What is claimed is:

1. A footwear comprising:

a foot covering;

a lining;

a sole on at least one of the foot covering and the lining;

the foot covering having an upper end and arranged above the at least one sole;

the lining arranged within the foot covering and having a lower end and an upper end;

the lining comprising a multilayered fabric which includes two parallel textile surfaces connected together via a layer of threads extending substantially perpendicularly with respect to the two parallel textile surfaces;

a compressible space being defined between the two parallel surfaces and extending from the lower end of the lining to the upper end of the lining; and the upper end of the lining being connected to the upper end of the foot covering via a turned over top peripheral stitch, wherein the lining allows perspiration to circulate from the lower end of the lining to one of the upper end of the lining and the top peripheral stitch.

2. The footwear of claim 1, wherein the lining comprises a material which allows perspiration originating within the lining to circulate freely from the lower end to the top peripheral stitch.

3. The footwear of claim 1, wherein each of the lining and the foot covering comprises a sole.

4. The footwear of claim 1, wherein the lining comprises a plurality of multilayered fabric pieces which are assembled together via a single, substantially median, longitudinal stitch.

5. The footwear of claim 1, wherein at least one of the two parallel textile surfaces comprises a breathable waterproof membrane.

6. The footwear of claim 1, wherein the foot covering comprises at least a partially breathable material.

7. The footwear of claim 6, wherein the at least partially breathable material is leather.

8. The footwear of claim 1, wherein the multilayered fabric is a three-dimensional fabric generally comprising two independent textile webs separated by the space and wherein the space comprises an aerated layer.

9. The footwear of claim 1, wherein at least one of the two parallel textile surfaces comprises a jersey web.

10. The footwear of claim 1, wherein at least one of the two parallel textile surfaces comprises one of a woven and a non-woven thread web.

11. The footwear of claim 1, wherein the lining comprises a three-dimensional fabric which is made of synthetic water-resistant materials.

12. The footwear of claim 1, wherein one of the two parallel surfaces comprises an inner surface adapted to contact a foot, the inner surface comprising a large mesh jersey material adapted to allow optimal evacuation in a direction substantially perpendicular to the two parallel textile surfaces.

13. The footwear of claim 12, wherein another of the two parallel surfaces comprises an outer surface disposed adjacent the foot covering, and wherein the footwear further comprises an additional layer disposed between the outer surface and the foot covering.

14. The footwear of claim 13, wherein the additional layer comprises a breathable waterproof membrane.

15. The footwear of claim 13, wherein the additional layer comprises a tight mesh fabric.

16. The footwear of claim 1, wherein the lining comprises two pieces of multilayered fabric which are assembled together via a single longitudinal stitch which is arranged substantially along a median longitudinal plane of the lining.

17. The footwear of claim 16, wherein the lining allows perspiration originating within the lining to circulate freely from the lower end of the lining to the longitudinal stitch, the lining allowing perspiration to rise vertically within the space.

18. The footwear of claim 17, wherein the longitudinal stitch comprises the only horizontal stitch in the lining between the lower end and a upper edge of the lining.

19. The footwear of claim 18, wherein an entire internal surface of the lining is adapted to evacuate perspiration generated moisture, via convection, from the lower end upwards to the longitudinal stitch, the perspiration being a vertical circulation of hot moist air which moves through the space.

20. The footwear of claim 1, wherein the lining is connected to the foot covering via a horizontal stitch, the horizontal stitch being disposed between the lower end and the top peripheral stitch, and wherein the horizontal stitch extends along a portion of a perimeter of the foot covering.

21. A footwear comprising:

a foot covering having an upper end arranged above a foot covering sole;

a lining arranged within the foot covering and having a lining sole, a lower end and an upper end;

the lining comprising a multilayered fabric which includes two parallel textile surfaces connected together via a layer of threads extending substantially perpendicularly with respect to the two parallel textile surfaces;

a compressible space being defined between the two parallel surfaces and extending from the lining sole to the upper end of the lining; and the upper end of the lining being connected to the upper end of the foot covering via a turned over top peripheral stitch, wherein the lining allows perspiration to circulate from one of the lining sole and the lower end of the lining to one of the upper end of the lining and the top peripheral stitch.

* * * * *